US006167725B1

(12) United States Patent
Siekierski

(10) Patent No.: US 6,167,725 B1
(45) Date of Patent: Jan. 2, 2001

(54) THREADLESS JEWELRY CONNECTOR ASSEMBLY

(75) Inventor: Tadeusz P. Siekierski, Concord, CA (US)

(73) Assignee: Neometal, Inc., Concord, CA (US)

( * ) Notice: Under 35 U.S.C. 154(b), the term of this patent shall be extended for 0 days.

(21) Appl. No.: 08/883,861

(22) Filed: Jun. 26, 1997

(51) Int. Cl.[7] ..... A44C 7/00

(52) U.S. Cl. ..... 63/12; 63/20; 24/618; 24/705; 24/707.6

(58) Field of Search ..... 24/618, 626, 705, 24/707.6; 63/3.1, 7, 12, 20; 403/273, 274, 282; 411/338, 339, 451, 446, 447; 29/525

(56) References Cited

U.S. PATENT DOCUMENTS

| | | | | |
|---|---|---|---|---|
| 931,869 | * | 8/1909 | Heinz | 411/447 X |
| 996,682 | * | 7/1911 | Taylor | 24/707.6 X |
| 2,006,813 | * | 7/1935 | Norwood | 411/447 X |
| 2,255,008 | | 9/1941 | Hargreaves . | |
| 3,250,171 | * | 5/1966 | Taylor | 411/451 |
| 3,423,956 | * | 1/1969 | Manne | 63/15.65 |
| 4,242,886 | | 1/1981 | Tucker . | |
| 4,827,941 | * | 5/1989 | Taylor et al. | 128/657 |
| 4,828,445 | * | 5/1989 | Giannuzzi | 411/446 X |
| 4,963,062 | * | 10/1990 | Giannuzzi | 411/446 X |
| 5,069,588 | * | 12/1991 | Hasan et al. | 411/447 X |
| 5,299,897 | * | 4/1994 | Marquardt | 411/447 X |
| 5,391,029 | * | 2/1995 | Fardell | 411/451 |
| 5,423,858 | * | 6/1995 | Bolanos et al. | 411/338 X |
| 5,489,178 | * | 2/1996 | Harker | 411/446 X |
| 5,638,700 | * | 6/1997 | Shechter | 63/12 |

FOREIGN PATENT DOCUMENTS

| | | | | |
|---|---|---|---|---|
| 165424 | * | 4/1954 | (AU) | 24/618 |
| 3 58 999 | | 9/1922 | (DE) . | |
| 358999 | * | 9/1922 | (DE) | 24/707.6 |
| 1 069 565 | | 5/1967 | (GB) . | |

* cited by examiner

*Primary Examiner*—Lynne H. Browne
*Assistant Examiner*—Andrea Chop
(74) *Attorney, Agent, or Firm*—Janis Biksa

(57) ABSTRACT

A jewelry connection system utilizing an elastic bent stem having a narrow center section is inserted into a hollow tube such that binding of the stem ends in the tube creates an elastic releasable friction bond (binding) between the stem and tube pieces. A controlled amount of binding can be introduced by controlling the degree of non-colinearity between mating surfaces such that when using a high modulus material, such as Titanium, the use of this system for body piercing openings such as ear and nose rings is successful without reduced risk of loss of jewelry pieces due to vibration, because threaded connections in this arrangement are avoided. Configurations according to the invention can be used in a variety of tiny jewelry pieces as long as a stem can be inserted into a stem receiving member.

8 Claims, 8 Drawing Sheets

THREADLESS JEWELRY CONNECTOR ASSEMBLY

FIELD OF THE INVENTION

This relates to the field of jewelry, in particular to connecting two parts of a jewelry assembly used to secure ornamental structures to parts of the body through holes made through layers of skin, e.g., ear rings, ear studs, nose rings, etc.

BACKGROUND OF THE INVENTION

For many years and dating back to early and primitive societies, the practice of ornamentation of the human body by piercing holes in the human skin and inserting some type of ornamental structure or jewelry has been known. More recently, in the western world, the use of body piercing has expanded much beyond the pierced ears for women of our parents' generation to multiple ear piercing, as well as piercing of facial features, such as the nose and lip, and other locations on the human body where folds of skin might be pierced to provide stimulation or enhancement to the wearer or to companions of the wearer when those parts of the body are exposed.

A common appliance used to provide body ornamentation through pierced openings is a barbell structure as pictured in FIG. 1. A central shaft 20 is threaded at both ends. A pair of ball structures 22, 24 are machined with threads and two short length of threaded stock 26, 28 are cut and fitted to the balls 22, 24. One end (the left end is shown in FIG. 1) is tightly assembled by the manufacturer while at the other end the threaded rod 26 is fixed tightly to the ball 22. In use when the shaft 20 passes through a body-piercing opening, the right hand side ball and thread unit 22, 26 can be removed and reattached by threading it into the end of the shaft 20. The enlarged balls 22, 24 on the ends of the shaft 20 provide an ornamental function, as well as acting as an end stop to prevent the ornamental piece from sliding out of the body-pierced opening to be lost.

Recent trends in body-piercing jewelry are to provide multiple piercings with smaller and smaller dimensions of jewelry so that they are nearly unnoticeable to the casual observer while still providing the desired effect among a particular peer group.

As a result of the demand for the decreasing sizes of jewelry, dimensions have gotten smaller and smaller until the rod 20, as shown in FIG. 1, is as small as 1/16 (0.0625) inches (1.58 mm). The drawback of structures so small is that it increases the care that a user desiring to wear an ornament attached to such a small rod has to use to separate the rod from its threaded end enlargement. Further once the rod is passed through the pierced opening, the required alignment between the halves of the threaded connection must be very precise to rejoin the end piece having very fine threads with the very small opening in the end of the rod. To the manufacturer of this ornament, the complexity and precision needed to machine threads into a small rod and a small ball end, as well as introducing and inserting a threaded stud are becoming nearly insurmountable. Further, once such a structure is assembled, it is subject to nearly constant vibration that can cause the screwed connection to begin to unravel. With such small threads and pieces, without constant and retightening it is nearly impossible to notice that the end piece is loose on the rod until it actually falls off.

Therefore, there is a need to provide an improved connection system as an alternative to a threaded connection system for body-pierced openings that is easy to assemble and reduces the likelihood that the assembly will come apart, or, if it starts to come apart that a user (wearer) will notice.

SUMMARY OF THE INVENTION

A tubular connection system as recited in the Claims is provided which is useful in connecting two parts of a jewelry set, particularly through a body-pierced opening. When using this configuration the dimensions of the connecting structures and their related ornamentation can be reduced and handled by a user without requiring the user to don magnifying glasses. The connection system provides an elastic, secure, nearly vibration-proof, connection whose partial separation can easily be observed and noticed by a quick glance.

A connector assembly according to the invention includes a tubular female piece attached to one part of the ornamental assembly while a stem (male piece) is attached to a second part of the ornamental assembly. The two pieces are configured to mate with each other. In a precursor arrangement, a simple straight stem is inserted into a hollow tube but such an arrangement provides nearly no retention function. However, when at least one piece is made of a material with a high modulus of elasticity and is configured into a bent shape, (either of the pieces may be bent). Then when the two pieces are slidably joined together, the one bent piece will elastically deform to cause a wedging or clamping action as a result of the interaction between the bent piece and the straight piece (or a partially bent piece). This interaction will cause the two pieces to bind to one another in a secure engagement. The larger the degree of bending, the greater the security, and the greater difficulty there is in separating the two pieces (the larger the separation force that must be used.

In one configuration according to the invention, a stem having a proximal end his a set of one or more proximal end engagement surfaces aligned to a proximal end longitudinal axis. The stem also has a distal end having a set of one or more distal end engagement surfaces aligned to a distal end longitudinal axis. While a circular orientation for the stem and tube is optimum for manufacturing and usability, regular or irregular polygon shapes may also be used on the circumference of the engagement surfaces. The stem mates with a stem-receiving member which has proximal and distal ends oriented oppositely from the proximal and distal ends of the stem. The stem-receiving member has a set of distal end surfaces aligned to a distal end longitudinal axis and a set of one or more proximal end surfaces aligned to a proximal end longitudinal axis. The receiving member distal and proximal end surfaces mate with the stem proximal and distal engagement surfaces to create a binding (frictional) force from the forcible (predominantly) elastic joining of a straight member with a bent (or curved) one. In each instance, it is important that at least one of the members—either the stem or the stem receiving member—have proximal and distal axes, at least one of which is not co-linearly aligned. A co-linearly alignment between the proximal and distal ends would mean, generally, that the structure is linear, which would provide no sidewards bending force. When the stem and stem-receiving member are in an engaged configuration a portion of one or more proximal and engagement surfaces of the stem are in contact with, and press against, a portion of the distal end surface of the stem-receiving member, and a portion of the set of one or more distal end engagement surfaces are in contact with and press against a portion of a set of one or more proximal end surfaces of said stem-receiving member, such that a releasable engagement is created between the two which will prevent disengagement of the two unless an external separating force is used.

In another configuration, a jewelry connection apparatus includes a first piece having a first stem having a first outer diameter, the first stem being bent so that an end view of the first bent stem has an outline having a second diameter which exceeds the first outer diameter in at least one direction. A second piece having a first linear tube having a third inner diameter that is larger that the first outer diameter but smaller than the second diameter such that insertion of the bent stem into the first tube causes an elastic straightening deflection of the first stem within the first tube to reduce the second diameter in said end view to within the third inner diameter, such that a releasable engagement is created between the first piece and the second piece, which will prevent disengagement of the two unless an external separating force is used. The external separating force is generally axial but can also be a twisting motion to reduce the frictional effect of the binding between pieces.

The jewelry connection stem can have a central portion having a reduced diameter to reduce binding in the tube.

The jewelry connection apparatus may further include a second stem portion substantially aligned to be in parallel with the first stem and, at least in one configuration, co-linear therewith. The second piece may include a second linear tube to receive the second stem such that the straightening deflection of the first stem occurs in cooperation with said second stem being inserted and engaged with the second linear tube.

Alternately, the jewelry connection apparatus configuration may be reversed such that the first piece has a first inner passage having a first inner diameter, the first inner passage being bent so that an end view of the first passage including hidden lines for a distance "A" along the first inner passage has an outline having a second diameter which exceeds the first diameter in at least one direction. The second piece also has a first linear stem having a third outer diameter with the third diameter being smaller than the first inner diameter such that insertion of the stem into the first inner passage for the known distance ("A") causes an elastic bending deflection of the first stem within the first inner passage, such that a releasable engagement is created between the first piece and the second piece which will prevent disengagement of the two unless an external separating force is used.

A method of making a releasable connection between jewelry pieces is also disclosed. It provides the steps of: providing a first piece with an elastic stem having a proximal end circumferential surface central axis and a distal and circumferential surface central axis with the two axes having a first attitude relative to one another when unconnected, and the step of insertion of the elastic stem into a tubular passage causing the proximal end circumferential surface central axis and the distal end circumferential surface central axis to elastically deflect to a second attitude resulting from the contact between a portion of the proximal end circumferential surface and a portion of the distal end circumferential surface and the correlating inner surfaces of the mating tubular passage. In one instance, the proximal end circumferential surface central axis and the distal end circumferential surface central axis of the first piece are not co-linearly aligned with each other when the pieces are unconnected. In a second instance, the two axes of the first piece are co-linearly aligned with each other when the pieces are unconnected. It is possible that each of the pieces would be very slightly bent (albeit not the same amount—as that would in one configuration form a curved tube inside a another curved lube) or that only one or the other of the pieces would be bent such that the longitudinal axes at the ends of the engagement pieces would have at least one set of those axes which are not aligned (i.e., the pieces bent) for the structure to engage and maintain a connection.

Alternately the method may include the steps of: providing a first piece with a high modulus of elasticity stem portion having a bend therein, when the first piece is not in an engaged configuration with a second piece, using a first force to insert and remove the stein portion in to and out from a tubular substantially smooth bore passage of a high modulus of elasticity tube portion of the second piece; and adjusting the first force by changing a degree of the bend and evaluating the acceptability of the changed first force by inserting the elastic stem portion in to and removing the elastic stem portion out from the linear tubular substantially smooth bore passage of the second piece. When the first piece is not in an engaged configuration with other pieces, a proximal end circumferential surface central axis and a distal end circumferential surface central axis of the stem portion are not colinearly aligned with each other. When the first piece is not in an engaged configuration with other pieces, a proximal end circumferential surface central axis and a distal end circumferential surface central axis of the stem portion are colinearly aligned with each other.

To utilize the device and method according to the invention, a material having a high modulus of elasticity must be used. An example of such a material is a 6/4 Titanium alloy (commonly known as $TiAl_6V_4$). Other materials may be a spring-grade steel; however, compatibility with the human body and avoiding allergic and infectious reactions must be considered such that 316L stainless steel, other Titanium alloys, Niobium and highly-alloyed gold material may be evaluated, and if the required elastic properties endure, may be used.

DETAILED DESCRIPTION

A configuration according to the present invention eliminates threaded connections and all its associated complications, and provides only an elastic linear insertion between a portable stem and a portable tube. An innovative stem center relieving arrangement is used which reduces the interference (binding) stress between the stem and the tube from the whole of the length of a cylindrical bent rod and a hollow tube to precisely manageable sections, distal and proximal sections of the stem and hollow tube, while allowing the engagement distance to be quite long to make assembly and disassembly relatively easy. A further advantage of the device according to the invention is its one-piece manufacturability which was heretofore unknown because of the requirements to mate end central pieces through the use of a threaded rod connection. A configuration according to the invention allows for smaller gauges of jewelry by eliminating the need for threads, and is easier to open and close than standard threaded jewelry. Opening and closing threadless jewelry is simple: twist and pull the ends to open, push back in to close.

Figure 1:
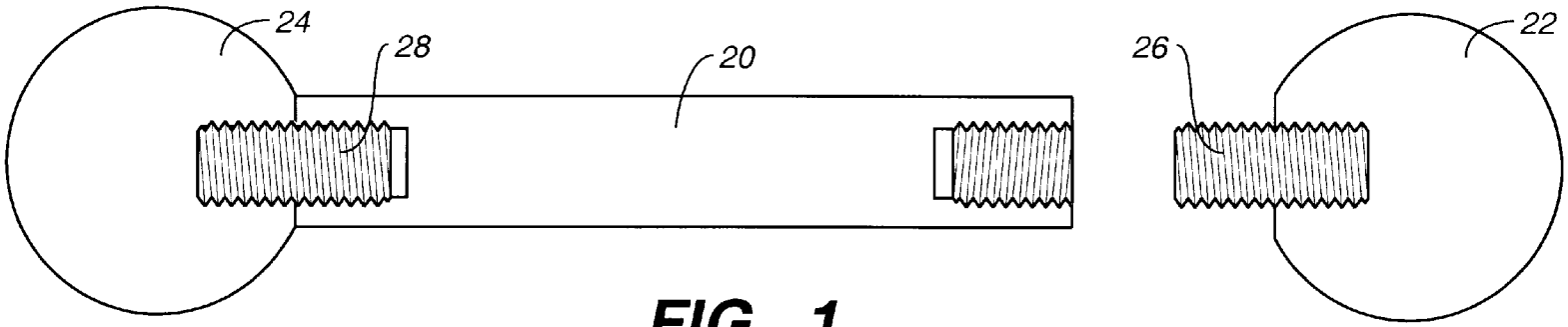
FIG. 1 (PRIOR ART)
FIG. 1 is a cross sectional view of a prior art threaded ornament (bar-bell) for use in a body-pierced opening.
Figure 13:
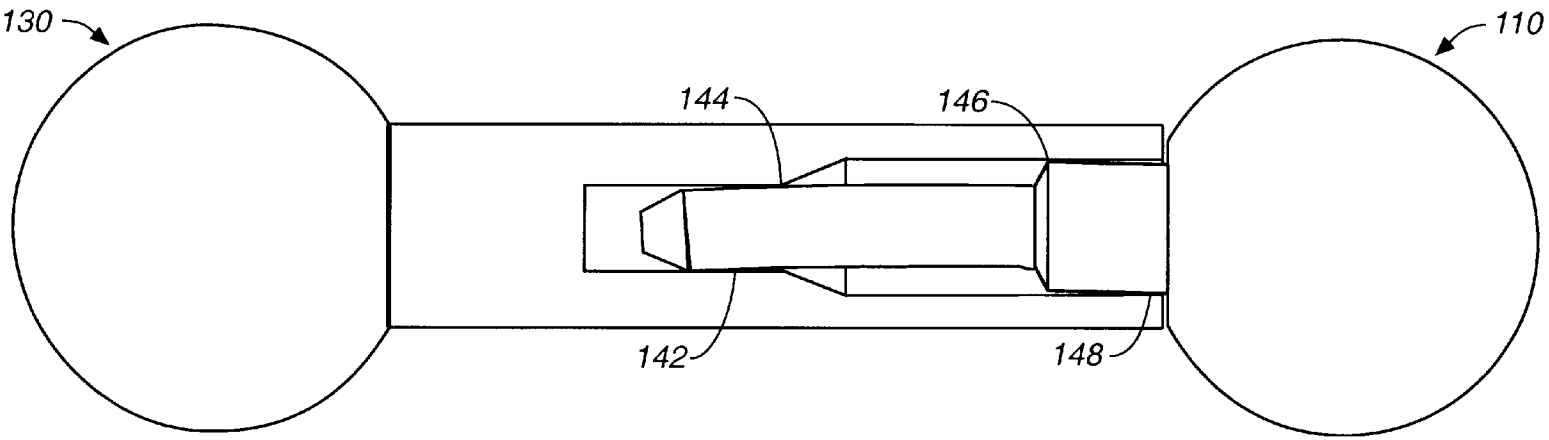
FIG. 13 shows an assembled configuration of the stem and stem-receiving tube as shown in FIGS. 11 and 12.
Figure 2:
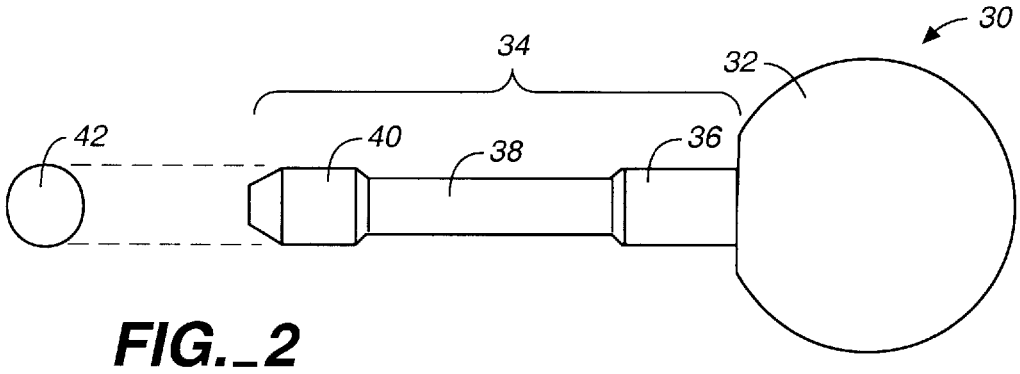
FIG. 2 is an as-manufactured (un-bent) side and partial end view of a stem according to the invention.

FIG. 2 shows an integral stem piece 30 (unbent configuration of the second piece 54 having a ball end 32 (second ornamental end portion having a fourth diameter) and a stem portion 34 (e.g., cylindrical stem portion having a fifth diameter 66, 68). The stem portion 34 includes a proximal end engagement surface 36 connected through a smooth (beveled) transition through a central narrow stem central portion 38 connected through another transition through a distal end engagement surface 40. The end of the length (of the cylindrical stem of the stem section may vary depending upon the length (first distance length of the linear hole of the first piece) of the stem in which it is to be inserted. In one example, the stem section 34 could be 0.200 inches (5.08 mm) in length with the diameter of the proximal end engagement surface 36 having a diameter of 0.0315 inches (0.80 mm) and a length of 0.047 inches (1.194 mm) while the distal end engagement surface is located at 0.110 inches (2.79 mm) away along the stem and has the same diameter but has a width of 0.030 inches (0.76 mm). The end of the stem transitions through a bevel to a butt end having a diameter of 0.015 inches (0.38 mm). All surfaces are to be polished to a mirror finish and the ball end 32 having a spherical radius of 0.060 inches (1.52 mm).

Figure 3:
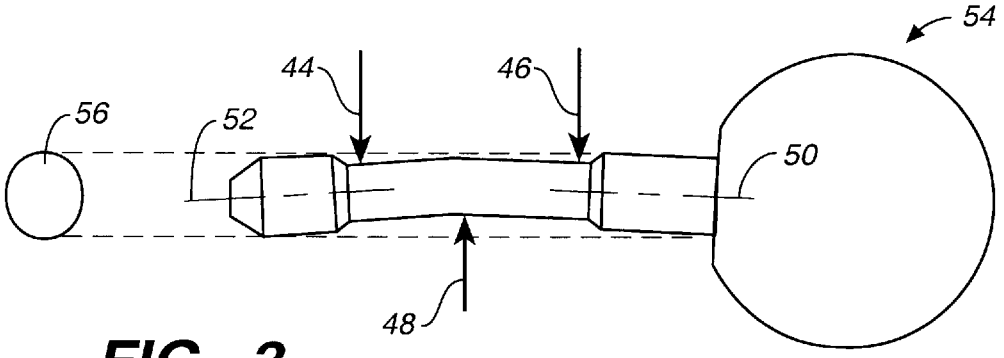
FIG. 3 is a side and partial end view of the stem of FIG. 2 bent in a simple three point bending jig to any bent orientation as required for the use with any structure according to the invention.
Figure 4:
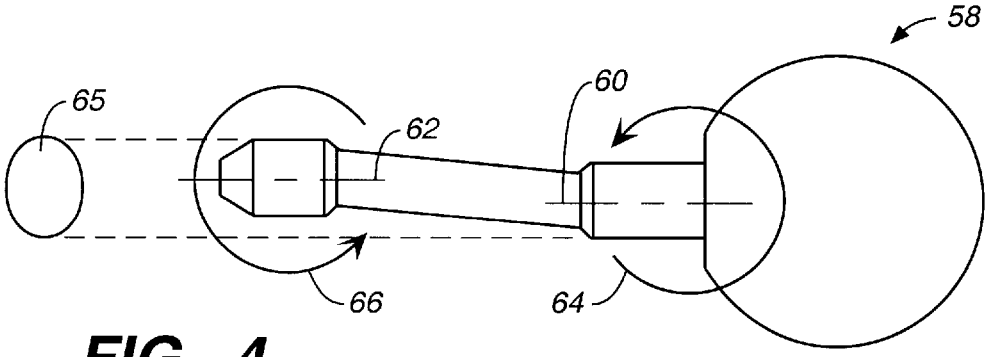
FIG. 4 is a side view of a stem of FIG. 2 which is bent to a distorted form using a set of couples providing another configuration for use of a stem according to the invention.

In FIG. 2 the end view 42 is a perfect circle showing the end view outline of the distal end engagements surface 40. The un-bent stem piece 30 is then put in a bending jig (not shown) which has a set of support points 44, 46, 48, such that the centralized support on one side 48 opposes two approximately equally distributed support forces 44, 46 on the other side. In a bending jig two opposing sets of forces are urged toward each other until plastic deformation in the stem portion 34 and, more specifically in the narrow central portion 38 takes place. As a result, the proximal end longitudinal axis 50 and distal end longitudinal axis 52 which are co-linearly aligned in the un-bent stem piece 30 become non-colinearly aligned, as shown in FIGS. 3, 4, a configuration of a bent stem piece 54. The degree of desired bending varies depending on a variety of factors. The tolerance/fit between the pieces may vary so that in some instances a greater bend is needed to establish acceptable binding (holding force) between pieces. In instances when the sliding tolerance between pieces is tight, a small bend will provide an acceptable holding force comparable to a holding force between more severely bent pieces having a greater fit distance between the pieces. The stem and stem receiving piece are of such a dimension that a user in his or her hands can easily bend one piece to increase or decrease the binding force between pieces. Thus the particular bending relationship will be established by the separation force that needs to be applied to separate the two pieces. Too high a separation force will create a nearly permanent connection (desirable by some users and not by others, while too loose a connection may cause the pieces to slide out of engagement with each other and be lost. The separation force must be large enough to resist the force of gravity when the stem axis is vertical and should be greeter so that vibration of the piece is not sufficient to cause separation The end view 56 of the bent stem piece 54 is a slightly an elliptical shape such that the extreme upper and lower edges of the stem portion 34 (lenght of cylindrical stem) are projected out to the end view 56.

FIG. 4 is an alternate arrangement of a bent stem piece 58. This bent stem piece also has a proximal end longitudinal axis 60 and a distal end longitudinal axis 62 which are generally in parallel but are offset by a given distance. This arrangement of the bent stem piece 58 is formed by holding the proximal end engagement surface or piece and rotating the distal end engagement surface 40 by opposite couple forces 64, 66. An end view 64, as shown by the projected lines to the end view, is an ellipse with a much larger diameter in the vertical direction, as shown in FIG. 4.

Figure 5:
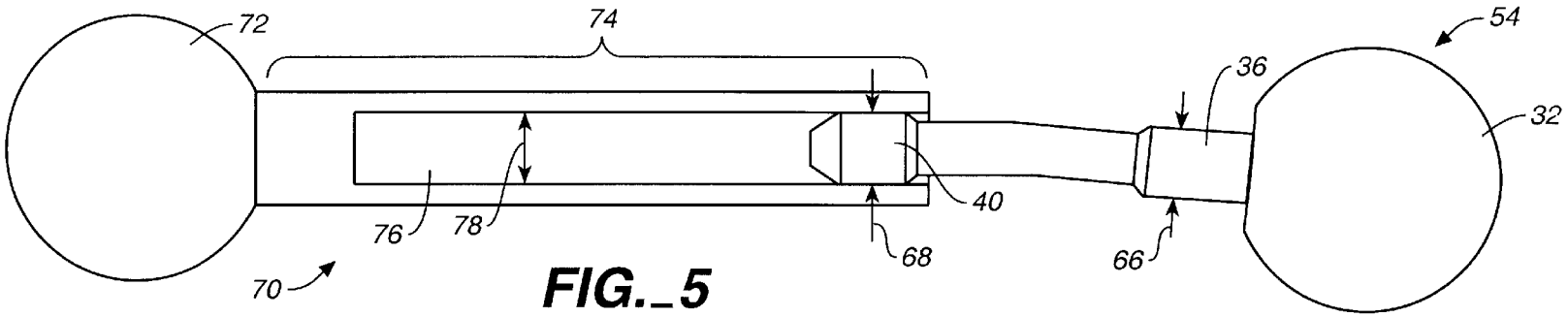
FIGS. 5, 6, and 7 show the progressive insertion of the stem of FIG. 3 into a female tube-receiving member according to the invention.
Figure 6:
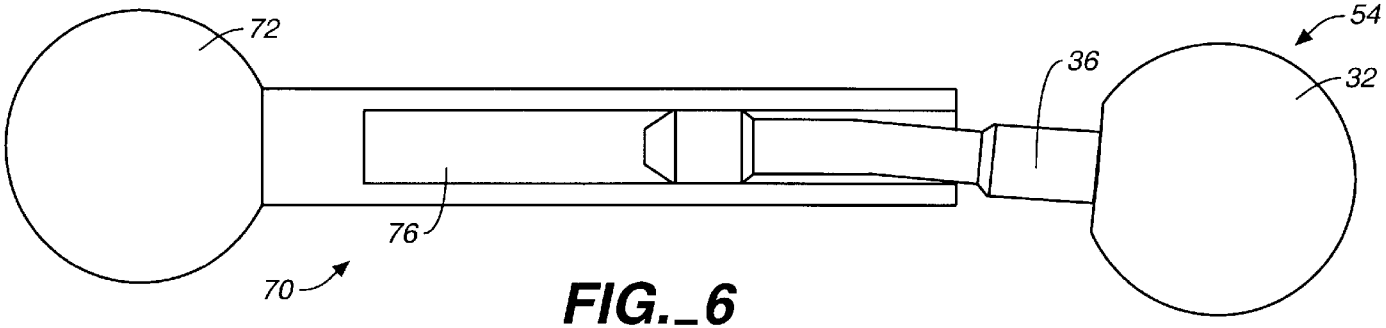
Figure 7:
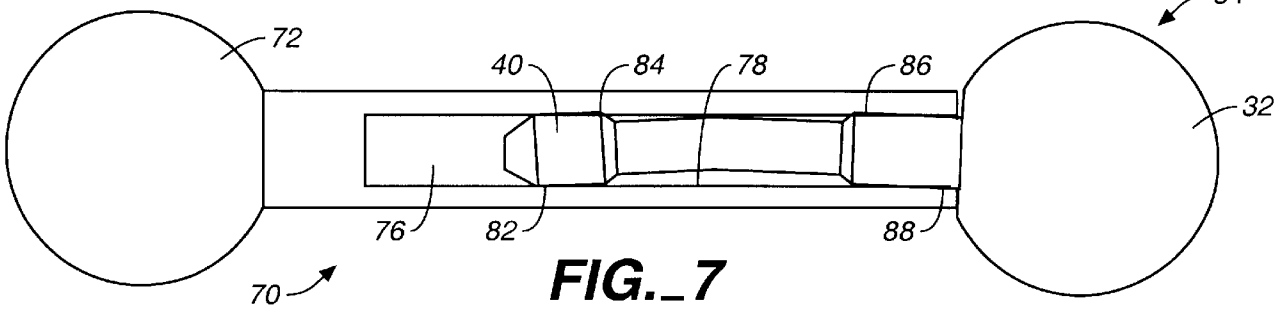

FIGS. 5, 6, and 7 show the progressive insertion of the bent stem piece 54 (second piece) into a female stem-receiving member 70 (first piece). The female stem-receiving member 70 includes a ball end 72 (first ornamental end portion 72 having a first diameter perpendicular to the first piece longitudinal axis) and a body piece 74 (tube portion having a second diameter (the outside diameter of the tube) sized to pass through a body piecing opening, the tube portion having a cylindrical outside diameter and an inner linear hole 76 extending for a first distance, the inner linear hole having an inner (third) diameter 78 extending for the first distance (greater than the stem length 34) from the tube end into said tube portion 74) which, in this case, is cylindrical, which includes an internal cylindrical passage 76 into which the stem portion 34 (cylindrical stem portion having a fifth diameter 66, 68) of the bent stem piece 54 is inserted. The diameter of 66 of the proximal end engagement surface 36 is approximately the same as the diameter 68 (approximately 0.0315 inches (0.80 mm)) of the distal end engagement surface 40. The inside diameter 78 of the internal cylindrical passage 76 is a drilled hole (substantially smooth bore) having a diameter of approximately 0.0320 inches (0.81 mm). Thus the distal end engagement surface of the stem 54 as it is inserted into the internal cylindrical passage 76 slides freely as long as the axis of the internal cylindrical passage is aligned with the distal end longitudinal axis 52 (stem piece 54 must be offset slightly to allow the two axes to be aligned). Once the end of the free sliding motion is reached as shown in FIG. 6 when the end opening of the body piece 74 comes in contact with a portion of the narrow central portion 38 of the stem. The narrow central portion of the stem has a diameter of approximately 0.023 inches (0.58 mm) having a length between a proximal end engagement surface 36 and the distal end engagement surface 40 of approximately 0.100 inches (2.54 mm) uniform diameter with a 0.005 inch (0.127 mm) transition at either end. The length of the stem portion 34 is approximately 0.200 inches (5.08 mm) compared to the length of the internal cylindrical passage 46 of the stem receiving opening which has a length (linear hole extending for a first distance) of approximately 0.260 inches (6.60 mm). Once the interfering position between the female stem receiving member 70 and the stem bent piece 54 as shown in FIG. 6 is reached, it is assumed that the female stem receiving member 70 is held at a constant attitude then the ball end 32 of the stem is raised to allow the proximal end engagement surface 36 to be inserted into the internal cylindrical passage 76 as shown in FIG. 7 (the stem diameter as can b e seen in the Figures has a diameter smaller than the diameters of the ball ends being such that they prevent an assembled arrangement from passing through a body piecing opening that the stem portion has passed through).

The fully engaged configuration of the bent stem piece 54 and the female stem receiving member 70 creates an elastic frictional and/or mechanical bond between the proximal and distal end surfaces, 36, 40 and the inside surface (in this instance circular, although it could be a non-circular or polygon shape) 78 such that a high frictional force as a result of the misalignment between the central axes of the internal cylindrical passage 76 and the axes 50, 52 of the proximal and distal engagement surfaces 36, 40. As can be seen in FIG. 7, binding (or a high frictional force) is created at four particular locations, 82, 84, 86, 88 (where location 84 can be designated as one side of the proximal end (edge or shoulder transition to the stem central portion) of the distal engagement surface 40, while location 86 can be designated as one side of the distal end (edge or shoulder transition to the stem central portion) of the proximal end engagement surface 36). Depending on the degree to which the bent stem piece 54 is bent (i.e. a severe bend or a gentle bent) The force to remove the bent stem piece 54 from the internal cylindrical passage 76 can be raised or lowered by increasing or decreasing the severity of the bend making the spring (elastic) forces female stem receiving member 70 and the bent stem piece 54 greater or lesser. For example, if the configuration according to the invention were to be used in an earring connection, the stem piece 54 would be bent less, because it would be understood that the benefit of the secure tight engagement between the two pieces is to be balanced with the ease of removability of the bent stem piece 54 where the stem receiving member 70 on earrings could be changed for example on a daily basis. Compare this to instances where the jewelry ornament to be retained by the jewelry connection system is to be maintained indefinitely until removal is desired, for example, over several weeks or months, then a larger joining force resulting from a more severe bend in the bent stem piece 54 would be utilized. For cylindrical members, an axial force alone for removal at some magnitude it would be sufficient to cause the two pieces to separate, however a twisting motion together with an axial force between the two would reduce the purely axial force needed to separate two pieces, thus making them easier to separate. While one particular configuration having a body piece 74 length is shown (this would be the portion of the jewelry connector that passes through a body piercing opening), the same configuration and orientation for the bent stem piece 54 and the internal cylindrical passage 76 can be maintained while extending the body piece 74 length from dimensions as small as 3/16 inch (4.76 mm) to as large as 3/4 inch (19.05 mm) while maintaining a small outer diameter, for example 0.051 inches (1.29 mm) for the outer diameter of the body piece 74.

Figure 8:
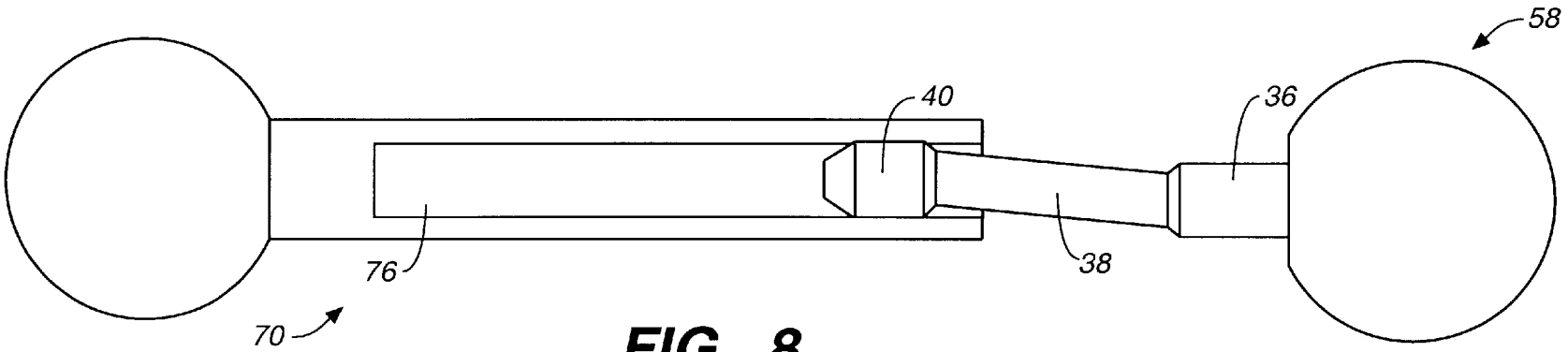
FIGS. 8 and 9 show that progressive insertion of a stem as shown in FIG. 4 into a Female tube-receiving member according to the invention.
Figure 9:
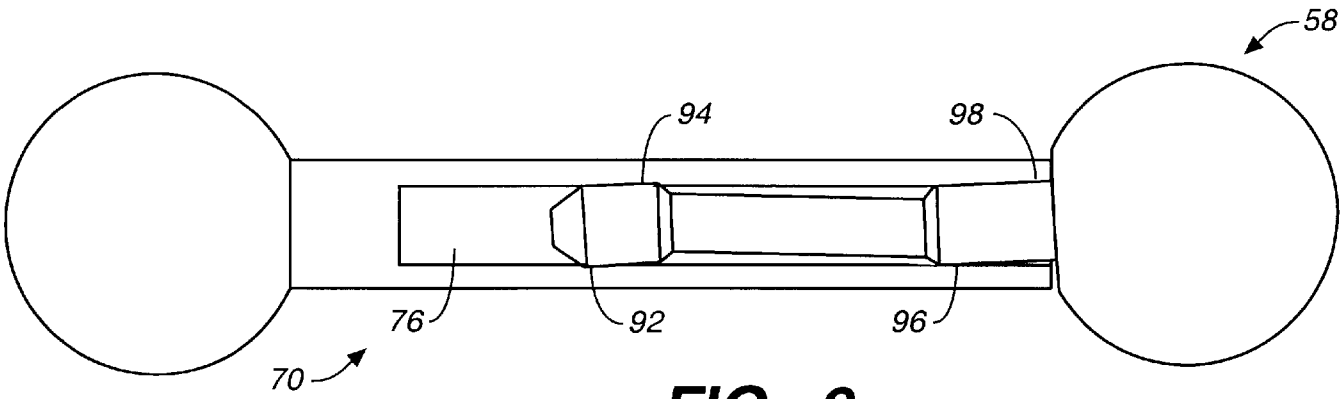

FIGS. 8 and 9 show an alternate arrangement according to the invention where the bent stem piece 58 as shown in FIG. 4 is shown in the progress of insertion into the internal cylindrical passage 76 of the female stem receiving member 70. In this instance again the distal end engagement surface 40 slides freely within the internal cylindrical passage 76 until an interference occurs between the narrow central portion 38 or the transition between the narrow central portion 38 and the, proximal end engagement 36. In this arrangement, as shown in FIG. 9, the areas of high binding or frictional force between the bent stem piece 58 and the female stem receiving member 70 occur at binding locations 92, 94, 96, 98.

Figure 10:
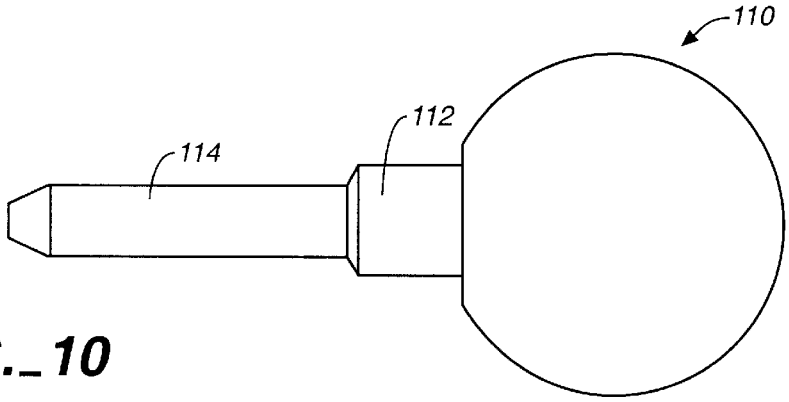
FIG. 10 shows a side view of an alternate embodiment of a stem according to the invention.
Figure 11:
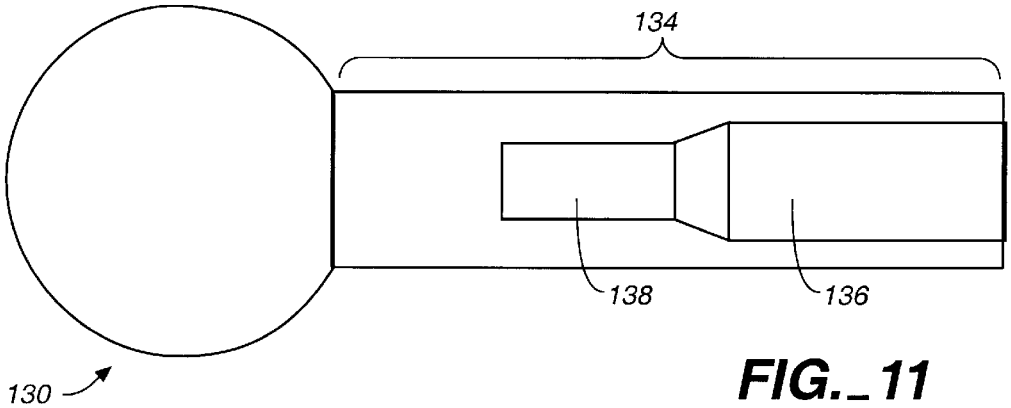
FIG. 11 shows a side cross sectional view of a female hollow receiving portion for the stem of the type shown in FIG. 10.

Another connection system according to the invention is shown in FIGS. 10, 11, 12, and 13. FIG. 10 shows an alternate embodiment of a stem piece 110 in its as machined (as formed) configuration. Again this piece can be formed from a single piece of stock in one machining operation without the need to utilize several machining operations. In the stem piece configuration as shown in FIG. 10, a proximal end engagement surface 112 has a larger diameter then the distal end engagement surface 114. The proximal and distal end engagement surfaces 112, 114 are aligned with proximal end and distal end longitudinal axes 116, 118. In the as machined configuration shown in FIG. 10, the axes 116, 118 are co-linearly aligned. The end view 120 of the distal end engagement surface has a circular pattern. However, when the distal end engagement surface 114 is plastically deformed (bent) to the side so that its proximal end longitudinal axis 116 is no longer aligned with the distal end longitudinal axis 118, the end view 122 of the bent piece has an elliptical shape.

Figure 12:
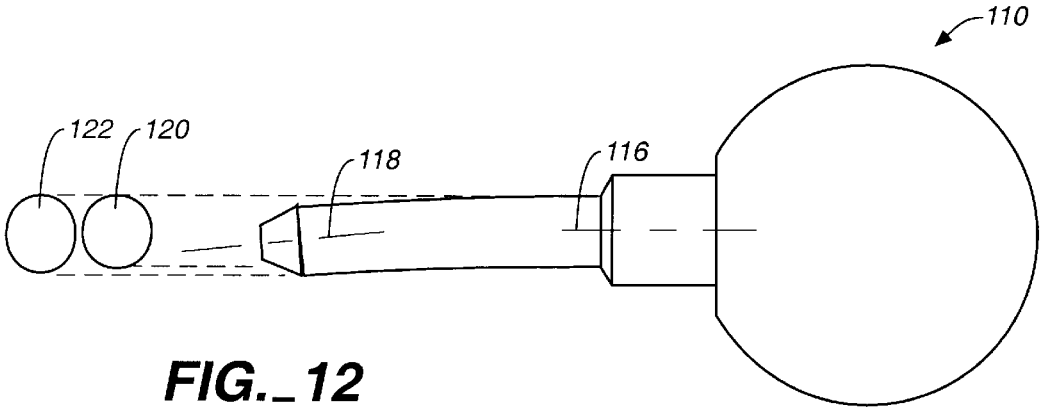
FIG. 12 shows side and partial end views of a stem configuration bent for use with a device according to the invention of the stem type shown in FIG. 10.

A stem-receiving member 130 includes an end ball piece 132 and a wide body piece 134. The wide body piece includes a wide diameter opening 136 and a narrow diameter opening 138 to engage the large diameter proximal end engagement surface 112 and the narrow distal end engagement surface diameter 114. When the stem piece 110 is engaged with the stem-receiving member 130 the bent configuration of the stem piece 110 as shown in FIG. 12 is elastically bound with points of high force (friction) contact at locations 142, 144, 146, 148 to maintain engagement between the two pieces. While the enlarged proximal engagement surface is shown co-linearly and concentrically aligned with the small and distal end engagement surface 114 they may be arranged not co-linearly or concentrically aligned initially with a similar receiving configuration for the openings 136, 138 in the stem receiving member 130. Those skilled in the art will understand that binding to retain the engagement between the members will occur when there is a misalignment between the male engagement surfaces and the female receiving opening surfaces. The example shown in FIGS. 10 through 13 provide one way of utilizing a configuration according to the invention with multiple diameters and sizes, but other configurations such as bending the receiving member and leaving the insertion member straight might also be utilized.

Figure 14:
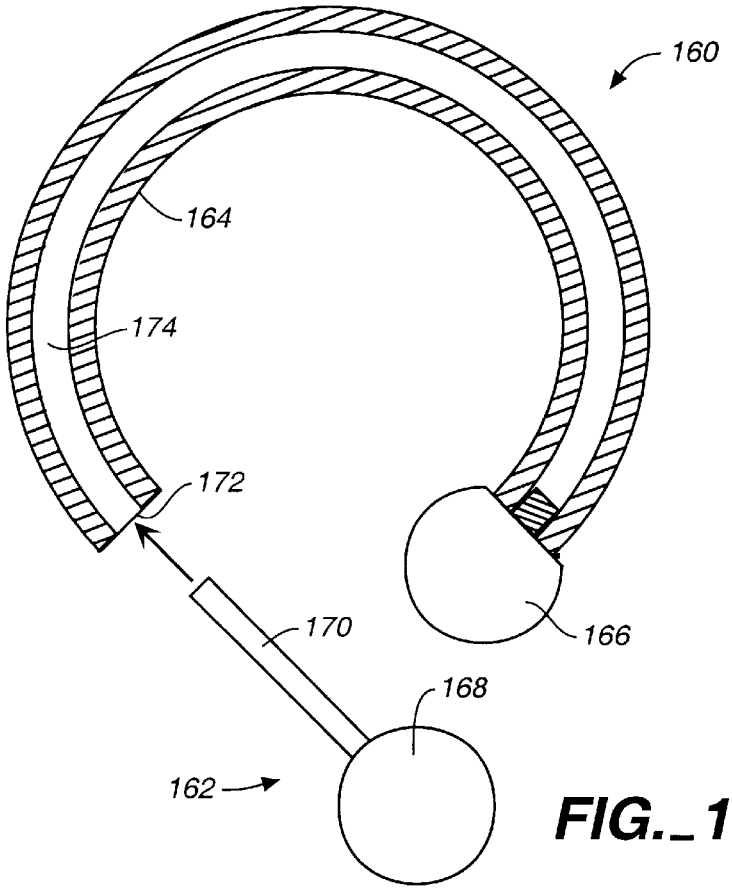
FIG. 14 shows a cross sectional view of a preassembly configuration of two pieces of a partial ring with a stem closure as would be used in a device according to the invention.
Figure 15:
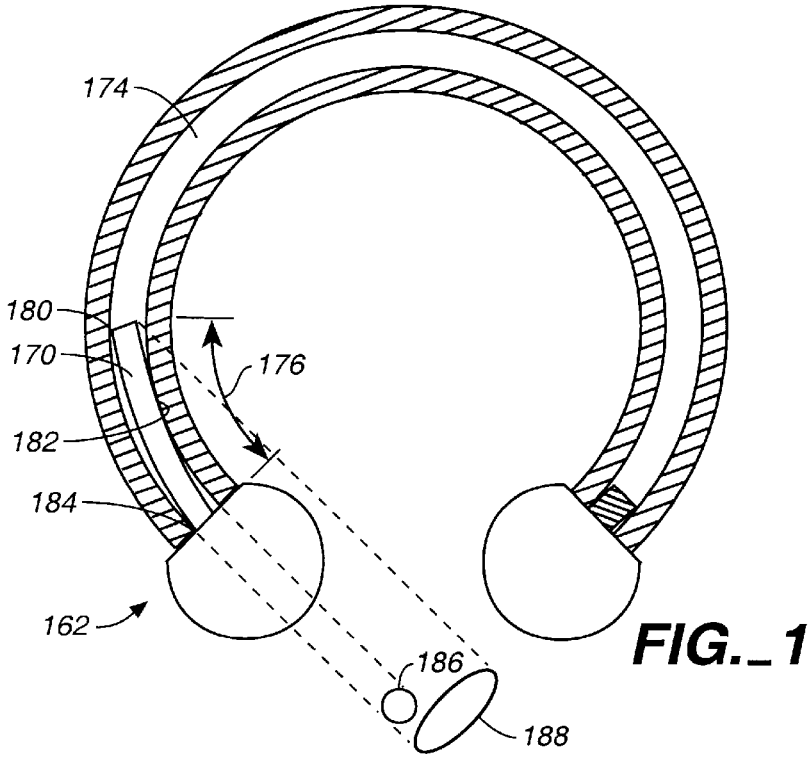
FIG. 15 shows a cross sectional view of the pieces of FIG. 14 assembled, as well as partial projected end views of the ends of the stem receiving openings and the partial bend of the stem receiving opening for a distance equal to the length of the stem.

FIGS. 14 and 15 show a partial ring arrangement assembly 160 with an insertable and removable end piece 162 (second piece) which can be inserted into a hollow core (curved hole) ring piece (first piece) such made, for example, from a tubing stock, from large sizes down to hypodermic needle-type sizes (second diameter—O.D.) and third diameter—I.D.). The partial ring 164 includes a central passage (third diameter) through which, at one end, a permanently installed end structure (first ornamental end portion, having a first diameter) or in this instance a ball 166 is fixed. The end piece 162 (second piece) includes a ball end piece 168 (second ornamental end portion, having a fourth diameter) and a stem piece 170 (cylindrical stem portion, having a longitudinal axis and a fifth diameter—the diameters of the ball end pieces 166, 168 being such that they prevent the assembly 160 from passing out of a body piecing opening penetrated by the diameter of said stem portion 164). A stem piece is made on a high modulus elasticity material, such as a Titanium or a spring steel shown as a substantially straight rod such that when it is inserted into the end opening 172 so that it follows the central passage 174 of the partial ring piece 164 as it elastically deforms. FIG. 15 shows the end piece 162 inserted to the base of the ball 168. The elastic stem 170 has been bent by the curvature of the internal passage 174 to have a sideways high contact force at locations 180, 182, 184. The stem 170 extends for longitudinal distance 176 (also known as "A") into the internal passage 174. An end view of the opening 172 in the end of the partial ring 174 is shown by the end view 186 which is a circle. The end view of the internal passage 174 for the distance 176 from the end opening 172 is shown by the end view of 188 which is an elongated ellipse. Thus, the bending of the stem piece 170 as it is inserted due to the curvature of the internal passage creates a binding/retaining force to hold the end piece and its ball 168 in position.

Figure 16:
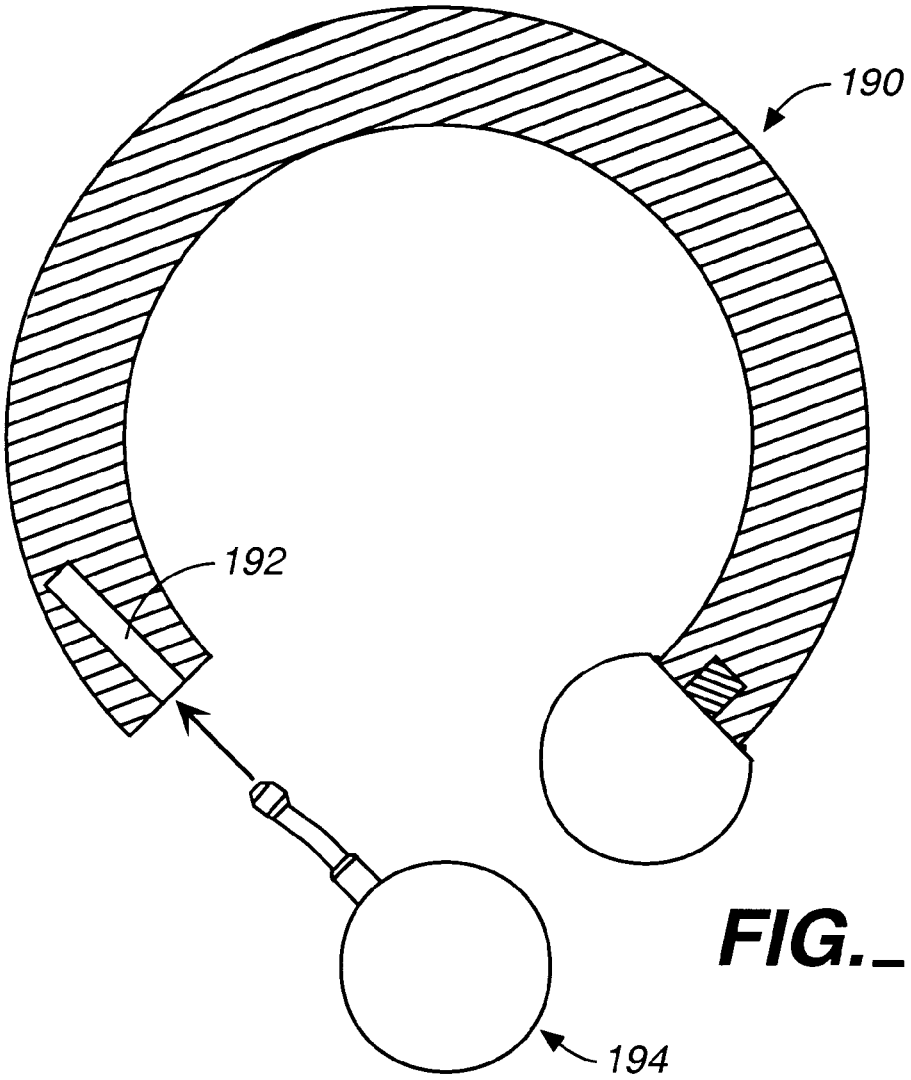
FIG. 16 shows a cross sectional view of an alternate embodiment of a circular piece showing the female tube-receiving opening in the partial circular ring while a stem configuration similar to that shown in FIG. 3 is shown ready for insertion into the partial ring.

FIG. 16 shows an alternate arrangement of a partial ring arrangement assembly 190. In this instance a ¾ ring is made of solid material but a stem-receiving opening 192 is formed in one end of the partial ring. A bent stem piece 192 constructed similar to the stem bent piece 54 in FIG. 3 is inserted into the internal cylindrical passage stem-receiving opening. FIG. 16 shows but one of the multiplicity of jewelry connection configurations and arrangements that might be used with a connection assembly according to the invention.

Figure 17:
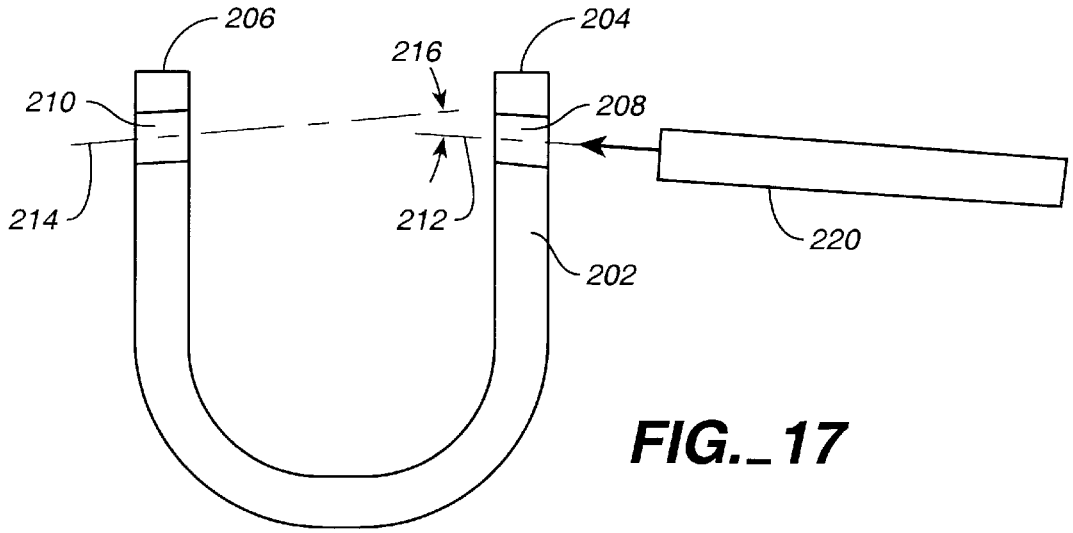
FIGS. 17, 18, and 19 show progressive assembly steps as might be used with an elastically secured device type ornament arrangement according to the invention.
Figure 18:
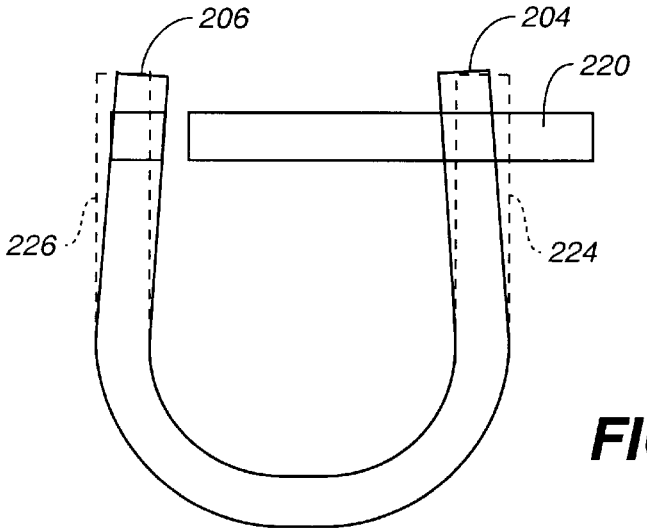
Figure 19:
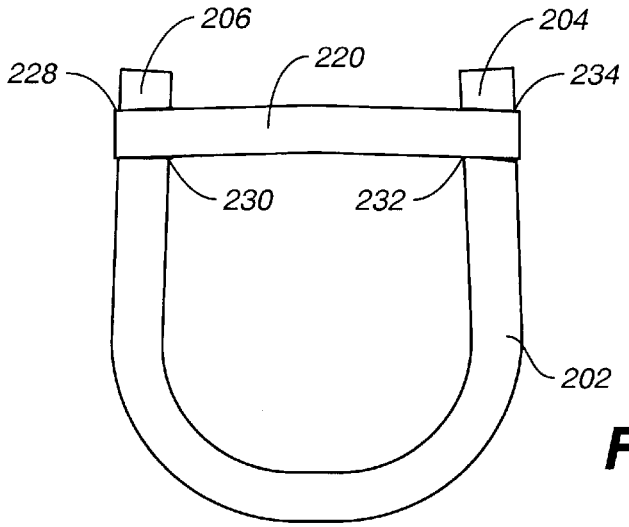

FIGS. 17, 18, and 19 show an alternate arrangement according to the invention using a nontubular receiving opening. In this instance, as shown in FIG. 17, a clevice assembly 200 includes a U-loop member 202 having a first end 204 and a second end 206 each having respective pin-receiving holes 208, 210. The pin-receiving holes 208, 210 are bored in the device ends 204, 206 along longitudinal axes 212, 214, respectively. The connecting pin 220 having a diameter slightly smaller than but in close tolerance with the diameters of the pin-receiving holes 208, 210 is shown in alignment with the longitudinal axis 212. The longitudinal axes 212, 214 in FIG. 17 in a relaxed state have an angle 216 between them. In this instance it can be of 4 to 8 degrees or more or less, depending upon the tolerances and forces that are desired by a designer, all well understood by a person of ordinary skill in the art. For assembly, the pin 220 is inserted to the pin-receiving hole 208 and slides along the angle of the longitudinal axis 212 until it reaches close to the second end 206. Then, as can be seen in FIG. 18, the fist end 204 and second end 206 are pressed together to be displaced from their relaxed positions as shown by the dashed lines 224, 226 so that the attitude of the first and second and longitudinal axes 212 and 214 are brought into co-linear alignment. The connecting pin 220 is then easily slipped into the second pin-receiving hole 210. Releasing the compression on the ends then creates a clamping force holding the two ends 204, 206 and pin 220 together in frictional tension. FIG. 19 shows the released, the engaged (tension), state of the device where the connecting pin 220 is elastically deformed (bowed as shown in FIG. 19) partially concave down while the first and second end pieces 204, 206 are not allowed to fully relax but bind on the connecting pin 220 through the pin-receiving holes 208, 210 with the primary contact force at locations 228, 230, 232, and 234. This arrangement showing an alternate embodiment of the invention rather than having a cylinder tube surrounding the length of the pin at the two proximal end engagement surfaces and distal end engagement surfaces are engaged with proximal and distal end surfaces of the pin-receiving member 202.

While the invention has been described with specific embodiments, those skilled in the art will recognize that changes can be made in form and detail without departing from the spirit and the scope of the invention.

I claim:

1. An ornamental jewelry connector assembly apparatus comprising:

a first piece having a first piece longitudinal axis, said first piece having a first ornamental end portion having a first diameter perpendicular to said first piece longitudinal axis, said first ornamental end portion is fixed to a tube portion having a second diameter sized to pass through a body piercing opening, said second diameter being smaller than said first diameter and said first diameter being sized such that said first ornamental end portion is prevented from passing through the body piercing opening through which said second diameter is sized to pass, said tube portion having an inside hole extending for a first distance into said tube portion from an end opposite said first ornamental end portion, said inside hole having a third diameter; and a second piece having a second piece longitudinal axis, said second piece having a second ornamental end portion having a fourth diameter perpendicular to said second piece longitudinal axis, said second ornamental end portion is fixed to a cylindrical stem portion, said cylindrical stem portion having a fifth diameter perpendicular to said second piece longitudinal axis and a length along said second piece longitudinal axis, wherein said fifth diameter is smaller than said third diameter and said length of said cylindrical stem portion is shorter than said length of said inside hole of said first piece, wherein said second diameter is smaller than said fourth diameter and said fourth diameter being sized such that said second ornamental end portion is prevented from passing through the body piercing opening through which said second diameter is sized to pass;

wherein, when said stem portion is in a relaxed condition, where said first piece is separate from said second piece, said stem portion includes a degree of bend such that an amount of force required to repeatedly insert said stem portion of said second piece into and repeatedly remove said stem portion of said second piece out from said inside hole of said first piece is adjustable by varying the degree of bend of said stem portion in said relaxed condition.

2. The ornamental jewelry connector assembly apparatus as in claim 1, wherein the stem portion is made of a Titanium alloy material having a high modulus of elasticity.

3. The ornamental jewelry connector assembly apparatus as in claim 2, wherein the tube portion is made of a Titanium alloy material having a high modulus of elasticity.

4. The ornamental jewelry connector assembly apparatus as in claim 1, wherein said tube portion of said first piece and said stem portion of said second piece are made of a material having a high modulus of elasticity.

5. The ornamental jewelry connector assembly apparatus as in claim 4, where varying the degree of bend in said stem portion can be done by a user in his or her hands.

6. The ornamental jewelry connector assembly apparatus as in claim 4, wherein said inside hole of said first piece has a substantially smooth bore.

7. The ornamental jewelry connector assembly apparatus as in claim 4, wherein said stem portion includes a stem central portion having a cross section and diameter smaller than a proximal end section cross section and diameter, respectively, which proximal end section and diameter are substantially equal to a distal end section cross section and diameter, and where said proximal end section has a substantially circular cross section.

8. The ornamental jewelry connector assembly apparatus as in claim 1, wherein said inside hole of said first piece is linear.

* * * * *